US010259628B2

(12) United States Patent
Altomare

(10) Patent No.: US 10,259,628 B2
(45) **Date of Patent: *Apr. 16, 2019**

(54) APPARATUS AND METHOD OF EMBEDDING ELECTRICAL CONDUIT WITHIN RECLOSABLE FASTENER SYSTEMS

(71) Applicant: Gerald C Altomare, Franklin Lakes, NJ (US)

(72) Inventor: Gerald C Altomare, Franklin Lakes, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/918,271

(22) Filed: Mar. 12, 2018

(65) Prior Publication Data

US 2018/0201420 A1 Jul. 19, 2018

Related U.S. Application Data

(63) Continuation of application No. 15/153,929, filed on May 13, 2016, now Pat. No. 9,944,445.

(60) Provisional application No. 62/161,855, filed on May 14, 2015.

(51) Int. Cl.

| | |
|---|---|
| ***B65D 63/10*** | (2006.01) |
| ***H01R 13/20*** | (2006.01) |
| ***A44B 18/00*** | (2006.01) |
| *H01R 13/627* | (2006.01) |

(52) U.S. Cl.

CPC ..... *B65D 63/1018* (2013.01); *A44B 18/0053* (2013.01); *H01R 13/20* (2013.01); *B65D 2563/107* (2013.01); *H01R 13/627* (2013.01)

(58) Field of Classification Search

CPC ..... B65D 63/1018; H01R 13/627; H01R 13/639; H01R 13/6395; A44B 18/0053

USPC ..... 439/371, 392, 422

See application file for complete search history.

(56) References Cited

U.S. PATENT DOCUMENTS

| | | | |
|---|---|---|---|
| 3,529,649 | A | 9/1970 | Bennett |
| 4,239,046 | A | 12/1980 | Ong |
| 4,446,900 | A | 5/1984 | Markovich |
| 5,078,266 | A | 1/1992 | Rackley |
| 5,111,354 | A | 5/1992 | Marzi et al. |
| 5,320,223 | A | 6/1994 | Allen |
| 5,384,939 | A | 1/1995 | Weber |
| 5,579,562 | A | 12/1996 | Hattori et al. |
| 5,669,495 | A | 9/1997 | West |
| 6,112,901 | A | 9/2000 | Noga et al. |
| 6,468,371 | B1 | 10/2002 | Poulakis |
| 6,722,496 | B2 | 4/2004 | Gantert |
| 7,108,761 | B2 | 9/2006 | Bell |
| 7,595,734 | B2 | 9/2009 | Long et al. |
| 7,658,809 | B2 | 2/2010 | Bell |
| 7,658,909 | B2 | 2/2010 | Patarin et al. |
| 7,670,639 | B2 | 3/2010 | Gallant et al. |

(Continued)

*Primary Examiner* — Hae Moon Hyeon
*Assistant Examiner* — Peter G Leigh
(74) *Attorney, Agent, or Firm* — Joseph P. Kincart; Rogers Towers, P.A.

(57) ABSTRACT

Methods and apparatus for reclosable fasteners with increased stability against horizontal movement and increased stability against horizontal movement of an embedded article that includes an electrical conduit within the reclosable fasteners. The reclosable fastener includes a hook and loop fastener or interlocking mushroom fastener. More specifically, the present disclosure presents reclosable fastener systems that securely contains and embeds an electrical conduit within the reclosable fastener system.

13 Claims, 10 Drawing Sheets

(56) References Cited

U.S. PATENT DOCUMENTS

| | | | |
|---|---|---|---|
| 7,900,666 | B2 | 3/2011 | Bell |
| 8,011,626 | B2 | 9/2011 | Poulakis |
| 8,104,615 | B2 | 1/2012 | Liu |
| 8,518,517 | B2 | 8/2013 | Poulakis |
| 8,657,975 | B2 | 2/2014 | Bell |
| 8,829,328 | B2 | 9/2014 | Silverstein |
| 8,899,416 | B2 | 12/2014 | McDonnough et al. |
| 8,910,350 | B2 | 12/2014 | Poulakis |
| 9,548,474 | B2 | 1/2017 | Silverstein |
| 2009/0100648 | A1 | 4/2009 | Naftalin et al. |
| 2009/0100651 | A1 | 4/2009 | Naftalin et al. |
| 2009/0276986 | A1 | 11/2009 | Janzen |

1401
1402

APPARATUS AND METHOD OF EMBEDDING ELECTRICAL CONDUIT WITHIN RECLOSABLE FASTENER SYSTEMS

CROSS REFERENCE TO RELATED APPLICATIONS

This application claims priority to U.S. patent application Ser. No. 15/153,929, entitled "APPARATUS AND METHOD OF EMBEDDING ARTICLES WITHIN RECLOSABLE FASTENER SYSTEMS" and filed May 13, 2016 which claims priority to U.S. Provisional Application No. 62/161,855; filed May 14, 2015, entitled APPARATUS AND METHOD OF EMBEDDING ARTICLES WITHIN RECLOSABLE FASTENER SYSTEMS, the contents of each of which are relied upon and hereby incorporated by reference.

FIELD OF THE DISCLOSURE

The present disclosure relates to methods and apparatus for reclosable fasteners with increased stability against horizontal movement and increased stability against lateral movement of an embedded article within the reclosable fasteners. The reclosable fastener may include, for example, a hook and loop fastener or interlocking mushroom fastener and an article of complementary shape and size. More specifically, the present disclosure presents reclosable fastener systems that may securely contain and embed an article within the reclosable fastener system.

BACKGROUND OF THE DISCLOSURE

Velcro is said to be the result of George de Mestral inventing a two-sided fastener; de Mestral's fastener included one side with stiff hooks like the burrs which had stuck to his pants while hiking and the other side with soft loops similar to fabric that made up his pants. Since the inception of Velcro, reclosable fasteners have been used to attach two objects, one object attached to the "burr" side of the reclosable fastener and the other object attached to the "fabric" side. The convenience of reclosable fasteners is based on how easily each half may be attached to an object and how generally easy it is to separate the two.

Traditional reclosable fasteners are designed to provide attachment strength, and in some instances slippage strength, between two sides of the reclosable fastener. However, these fasteners are not designed to provide lateral stability for an article embedded within the reclosable fastener. What is needed is therefore is a reclosable fastener and article system that provides lateral stability in a useful and practical way.

SUMMARY OF THE DISCLOSURE

Accordingly, the present invention provides the ease of attachment and disengagement of traditional reclosable fasteners and enhanced stability against movement in at least one direction of an embedded article and fastener in relation to each other. For some purposes, sufficient enhanced stability is provided by aspects, such as the size or shape, of the embedded article. For other purposes, enhanced stability is provided by internal engagement of additional components or enhanced components included as part of a reclosable fastener. The present invention provides for a reclosable fastener and article system that is particularly useful to secure articles embedded within the improved reclosable fastener that may enhance and complement the stability and strength of the article that is secured by two halves of the improved reclosable fastener system.

Accordingly, the present disclosure describes embodiments of improved reclosable fastener systems. In one aspect, some embodiments of the present invention provide for a reclosable fastener with increased stability in at least one direction. In other aspects, some embodiments of the present invention provide improved reclosed fastener systems that may be configured to securely hold at least one embedded article within a reclosable fastener.

According to some implementations of the present invention, a reclosable fastener system may securely contain an embedded article. The reclosable fastener system may include a first substrate of fastener components including a first generally planar base and with multiple first reclosable fastener components fixedly attached to the first generally planar base. The first substrate of fastener component may be placed in close proximity to a second substrate of fastener components including a second generally planar base and with multiple second reclosable fastener components fixedly attached to the second generally planar base. The second reclosable fastener substrate components are complementary to the first reclosable fastener components such that the first and second reclosable fastener components may be purposefully arranged on the first generally planar base and the second generally planar base respectively to receive an article in a manner that will allow for the substantial engagement of the first reclosable fastener components and the second reclosable fastener components and secure the article between the first fastener substrate and the second fastener substrate.

In some implementations, one or both of the first substrate and the second substrate additionally includes a resilient layer proximate to one or both of the first fastener components and the second reclosable fastener components, the resilient layer may be formable by an article received between the first reclosable fastener substrate and the second reclosable fastener substrate while the first reclosable fastener substrate may be engaged with the second reclosable fastener substrate.

In some implementations one or both of the first substrate and the second substrate further includes a stability frame for positioning an article in a pattern between the first reclosable fastener substrate and the second reclosable fastener substrate while the first reclosable fastener substrate may be engaged with the second reclosable fastener substrate.

In some implementations the stability frame may be sized to receive one or more of: a wire, a ribbon cable, a tube, a pipe, a fiber optic cable. The stability frame may provide increased mechanical properties in one or both of an X and a Y direction relative to the first generally planar base.

In some implementations, an X, Y reinforcement provides resistance against movement in both an X direction and a Y direction relative to the first generally planar base. The X, Y reinforcement may or may not significantly limit movement in a Z direction relative to the first generally planar base.

In some embodiments, a reinforcement may include a stud penetrates one or both of the first reclosable fastener substrate and the second reclosable fastener substrate. Moreover, in some embodiments, the X, Y reinforcement may be fixedly attachable to an object onto which one of: the first substrate of fastener components and the second substrate of fastener components may be mounted.

In some embodiments, the X, Y reinforcement may be fixedly attachable to an object onto which one of the first reclosable fastener substrate and the second reclosable fastener substrate may be mounted via a bolt.

In some embodiments, the reclosable fastener system may additionally include at least a portion of the first substrate of fastener components includes an electrical contact and at least a portion of the second substrate of fastener components includes an electrical contact.

In some embodiments, the first substrate of fastener components may be engaged with the second substrate of fastener components the electrical contact of the first substrate of fastener components may be in electrical communication with the electrical contact of the second substrate of fastener components.

In other aspects, in some embodiments, an article of a predetermined size and shape may be placed into contact with a first reclosable fastener substrate including a first fastener base and multiple first fastener components fixedly attached to the first fastener base, the first fastener components patterned to receive the article according to the size and shape of the article; thereby engaging the first reclosable fastener with a second reclosable fastener thereby securing the article within the first reclosable fastener.

In some implementations, the pattern of components including the second fastener may be aligned with the article. The article may also be placed into a resilient layer proximate to one or both of the first fastener components and the second fastener components, the resilient layer formable by an article received between the first reclosable fastener substrate and the second reclosable fastener substrate while the first reclosable fastener substrate may be engaged with the second reclosable fastener substrate.

In some implementations, the article may be placed into a stability frame for positioning the article in a pattern between the first reclosable fastener substrate and the second reclosable fastener while the first reclosable fastener substrate may be engaged with the second reclosable fastener substrate. The stability frame may provide increased mechanical properties in one or both of an X and a Y direction relative to the first fastener base.

In some implementations, at least a portion of the first base includes an electrical contact and at least a portion of the second base includes an electrical contact and the electrical contact included in first fastener base may be placed in electrical communication with the electrical contact included in the second fastener base. For example, the electrical communication may include a data signal or an alternating current.

One general aspect includes a reclosable fastener system for securely containing an embedded article, where the reclosable fastener system includes: a first reclosable fastener substrate including a first generally planar base. The reclosable fastener system also includes multiple first fastener components fixedly attached to the first reclosable fastener substrate. The reclosable fastener system also includes a second reclosable fastener substrate including a second generally planar base; multiple second fastener components fixedly attached to the second reclosable fastener substrate, where the second fastener components are complementary to the first fastener components; and the first and second fastener substrates are arranged to purposefully receive an article in a manner that will allow for a substantial engagement of the first fastener components and the second fastener components and secure the article between the first reclosable fastener substrate and the second reclosable fastener substrate.

Implementations may include one or more of the following features. The reclosable fastener system where one or both the first substrate and the second substrate additionally includes a resilient layer proximate to one or both of the first fastener components and the second fastener components, the resilient layer formable by an article received between the first reclosable fastener substrate and the second reclosable fastener substrate while the first reclosable fastener substrate is engaged with the second reclosable fastener substrate. The reclosable fastener system where one or both the first substrate and the second substrate further includes a stability frame for positioning an article in a pattern between the first reclosable fastener substrate and the second reclosable fastener substrate while the first reclosable fastener substrate is engaged with the second reclosable fastener substrate. The reclosable fastener system where the stability frame is sized to receive one or more of: a wire, a ribbon cable, a tube, a pipe, a fiber optic cable. The reclosable fastener system where the stability frame provides increased mechanical properties in one or both of an x and a y direction relative to the first generally planar base.

The reclosable fastener system may additionally include an x, y reinforcement providing resistance against movement in both an x direction and a y direction relative to the first generally planar base. The reclosable fastener system may additionally include x, y reinforcement that does not significantly limit movement in a z direction relative to the first generally planar base. The reclosable fastener system may additionally include x, y reinforcement that includes a stud penetrating one or both of the first reclosable fastener substrate and the second reclosable fastener substrate.

One general aspect includes a method of securing an article with a reclosable fastener system, the method including the steps of: placing an article of a predetermined size and shape into contact with a first reclosable fastener substrate including a first fastener base and multiple first fastener components fixedly attached to the first fastener base, the first fastener components patterned to receive the article according to the size and shape of the article; and engaging the first reclosable fastener with a second reclosable fastener thereby securing the article within the first reclosable fastener and the second reclosable fastener.

Implementations may include one or more of the following features: aligning a pattern of components including the second fastener with the article; placing the article into a resilient layer proximate to one or both of the first fastener components and the second fastener components, the resilient layer formable by an article received between the first reclosable fastener and the second reclosable fastener while the first reclosable fastener is engaged with the second reclosable fastener; placing the article into a stability frame for positioning an article in a pattern between the first reclosable fastener and the second reclosable fastener while the first reclosable fastener is engaged with the second reclosable fastener; the stability frame providing increased mechanical properties in one or both of an x and a y direction relative to the first fastener base; at least a portion of the first fastener base including an electrical contact and at least a portion of a second fastener base includes an electrical contact and the method additionally includes the step of placing the electrical contact included in first fastener base in electrical communication with the electrical contact included in the second fastener base; and the electrical communication including a data signal and/or an alternating current.

Other aspects of the disclosed innovation will be apparent in the following description and the accompanying drawings.

BRIEF DESCRIPTION OF THE DRAWINGS

The accompanying drawings, that are incorporated in and constitute a part of this specification, illustrate several embodiments of the disclosure and, together with the description, serve to explain the principles of the disclosure.

DETAILED DESCRIPTION

The present disclosure provides generally for a reclosable fastener system with improved stability in at least one direction. The improved stability may be configured to securely hold an embedded article within the reclosable fastener system. In some embodiments, a direction of improved stability may be inherent in the design of the fastener system. In some systems the stability may be based on the design of the embedded article.

In the following sections, detailed descriptions of examples and methods of the disclosure will be given. The description of both preferred and alternative examples though through are exemplary only, and it is understood that to those skilled in the art that variations, modifications, and alterations may be apparent. It is therefore to be understood that the examples do not limit the broadness of the aspects of the underlying disclosure as defined by the claims.

Glossary

- Component: as used herein refers to a portion of a Reclosable Fastener System that is fixedly attached to a substrate and able interact with one or more other portions of the Reclosable Fastener System or article.
- Reclosable Fastener System (RFS): as used herein refers to a fastening system comprising two halves, wherein one half includes a substrate with series of fasteners complementary to the other half. The complementary fasteners may securely fasten to each other, wherein separation may occur when deliberate and sufficient force is applied.
- Substrate: as used herein refers to a RFS base, wherein one or more components of an RFS may be attached to the substrate.
- Fastener: as used herein refers to a mechanism that may be securely connected to a complementary fastener.
- Article: as used herein refers to an object that may be embedded within an RFS. For example, in some embodiments, an article may include a straight or formed wire, a ladder shaped structure, a mesh structure, solid shapes, a ring, a hook, or tubing.
- Void: as used herein refers to a fastener gap on a substrate, wherein an article may fit within the void.
- Stud: as used herein refers to an anchor point within a RFS, wherein the anchor point may add stability and strength.

Figure 1A:
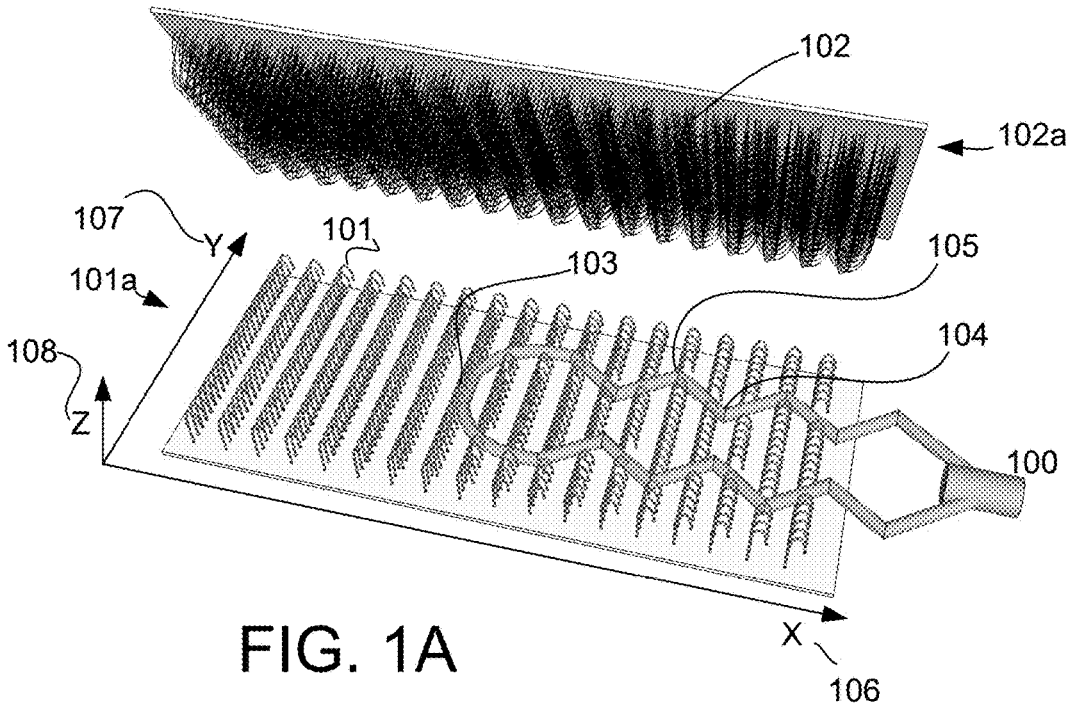
FIG. 1A illustrates an exemplary embodiment of an RFS is illustrated, wherein the fasteners include a hook and loop system.
Figure 1B:
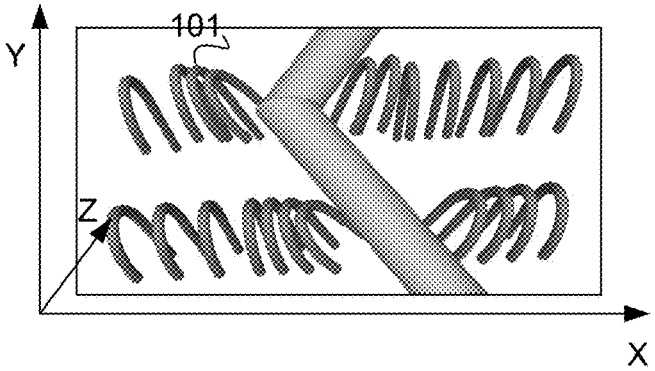
FIG. 1B illustrates an exemplary embodiment of an RFS, wherein the fasteners include a hook and loop system.

Referring now to FIGS. 1A and 1B, exemplary embodiments of an RFS is illustrated. As illustrated, respective halves of the fastener 101*a* and 102*a* include a hook 101 and loop 102 system. A joining of a first half with a first substrate of fastener components 101*a* with a second half with a second t substrate of fastener components 102*a* causes the hooks 101 to interact with the loops 102 and secure the first half 101*a* with the second half 102*a*. Once secured, movement is limited in any of a trilateral of directions. As referred to herein, an X direction 106, a Y direction 107 and a Z direction 108. In some embodiments, the fastener includes one or both of hooks 101 and loops 102 that are flexible enough to accept an article 110 without a pattern of hooks 101 and loops 102 shaped void of hooks 101 and or loops 102 to receive the article 110. Such embodiments may be adjustable and may accept one or more different shapes and sizes without modification to the fastener halves 101*a* 102*a*. Essentially, in some exemplary embodiments, an RFS may remain unmodified and be able to accept an article designed to not move within the RFS.

In some embodiments, an article 110 may include one or more curved sections 103, indentations 104, or outward detents 105 that may interact with the hooks 101 and loops 102 to secure the article in a fixed position and restrain the article 110 from movement in any of the X 106, Y 107 and Z 108 directions.

Referring now to FIG. 1B, an close up view of a portion of 1A is illustrated it may be noted that, in some embodiments, the tensile strength of restraint of the article 110 in the X 106 and Y 107 directions will be greater than the tensile strength restraining the article in the Z 108 direction since the article is restrained in the X 106 and Y 107 directions according to the mechanical strength of the hooks 101 and the loops 102 inter-engaged as well as the stiffness of hooks and loops whether or not inter-engaged to resist movement in the X and Y directions. The tensile strength restraining the article 110 in the Z 108 direction is essentially a factor of, and congruent to, the separation tensile strength of the hooks 101 and loops 102.

Figure 2:
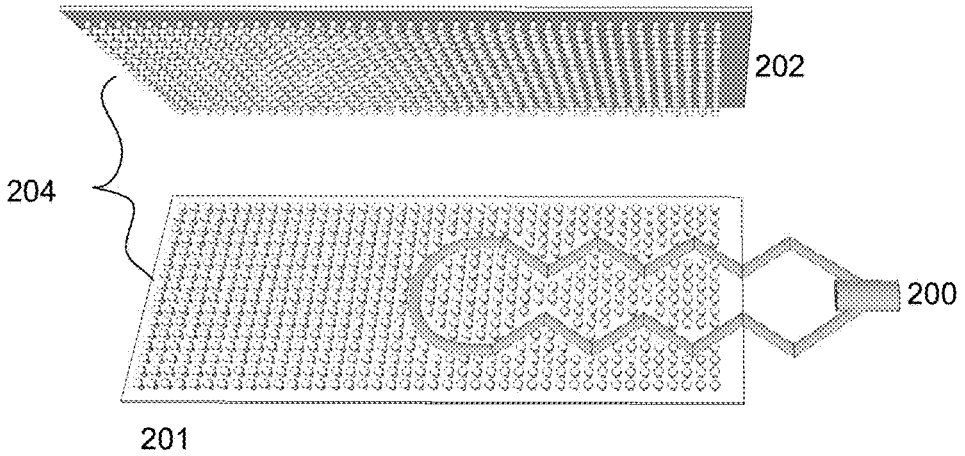
FIG. 2 illustrates an alternate exemplary embodiment of an RFS, wherein the fasteners include a mushroom system.

Referring now to FIG. 2, an alternate exemplary embodiment of an RFS 204 is illustrated, wherein one or both of a first substrate of fastener components 201 and a second strip of fastener components 201 include mushroom shaped interlocking components. In some embodiments, a fastener series on one substrate half may include a patterned area devoid of connector components, such as, for example hook and loop components or mushroom or button shaped components. In some embodiments, the patterned shape of one or both substrates of components may match the shape of an article that will be received by the RFS. In such embodiments, one or both strip of fastener components 201 and 202 may be customized to receive an article of a specific shape and size. Some embodiments may include multiple cut away portions to receive articles of various shapes and sizes. Accordingly, the devoid area, or void, may be shaped to accept an article of a specific shape and size and essentially replicate a shape and size of the article 200 to be received. In some aspects, individual fasteners within a fastener series may be removable, wherein the void may be customizable. In some aspects, the rigidity within the mushroom or hook and loop system may allow thin articles, such as wire or hair, to be embedded within the RFS without requiring a void.

Figure 3:
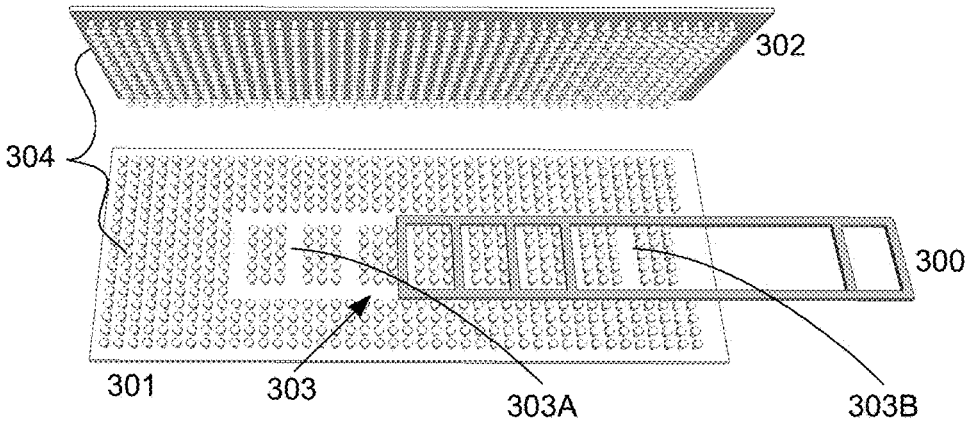
FIG. 3 illustrates an exemplary embodiment of an RFS with an alternate article.

Referring now to FIG. 3, an exemplary embodiment of an RFS 304 with a patterned area 303 devoid of attachment components, such as hook and loop or button components is illustrated. The patterned area may be shaped to receive one or more articles 300. As illustrated, multiple alternate placement patterned areas or areas void of fastener components 303A-303B may be located in a component substrate strip of an RFS 304, comprising complementary component strips 301, 302. In some embodiments, an article may include a ladder shape or other corresponding shape and be placed within a grid of placement positions within a void 303A-303B. In some aspects, the void 303 may be shaped to allow different positioning of the article within a void. In some aspects, the ladder shape article may be useful as a fixed or stepped distance guide with a prescribed measurement, such as 0.5 inches per step, or 2 centimeters per step.

Articles may also include items to be attached proximate to a human body, such as for example a smart device, a mobile communications device, medical apparatus, a firearm, personal defense implement, medical tubing, therapeutic substance container, or other item.

Figure 4:
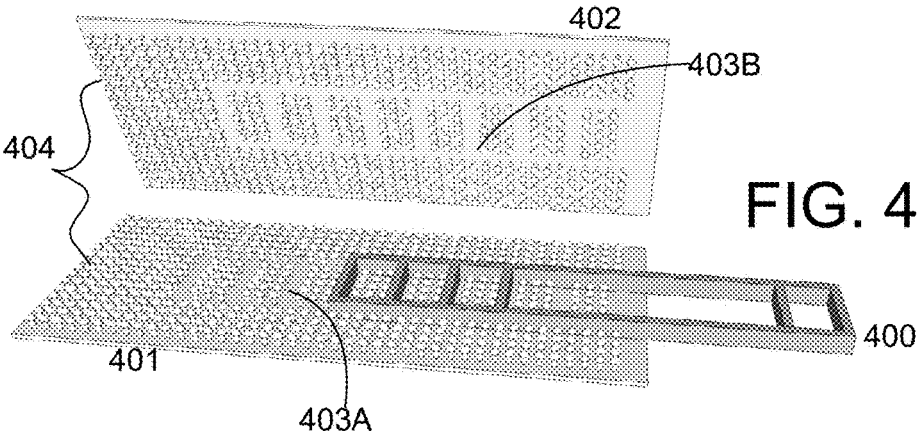
FIG. 4 illustrates an exemplary embodiment of an RFS with an alternate article.

Referring now to FIG. 4, an exemplary embodiment of an RFS 404 with a first void area 403A in a first RFS component strip 401 a second void area 403B in a second RFS strip 402. An article 400 may be positioned in one or both of the void areas 403A-403B.

In some aspects, an article 400 may extend beyond the height of a fastener series. In some embodiments, the substrate halves may include a flexible material, wherein the substrate halves may bend around the large article, allowing the fastener series to engage.

Figure 5A:
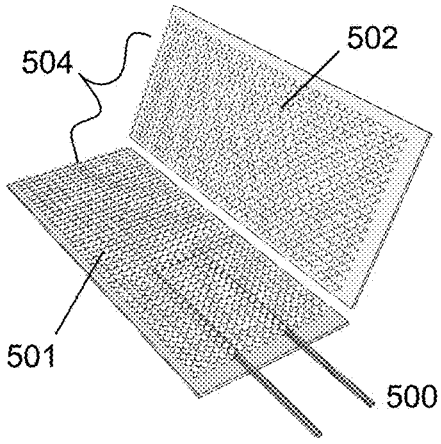
FIG. 5A illustrates an exemplary embodiment of an RFS with an alternate article.
Figure 5B:
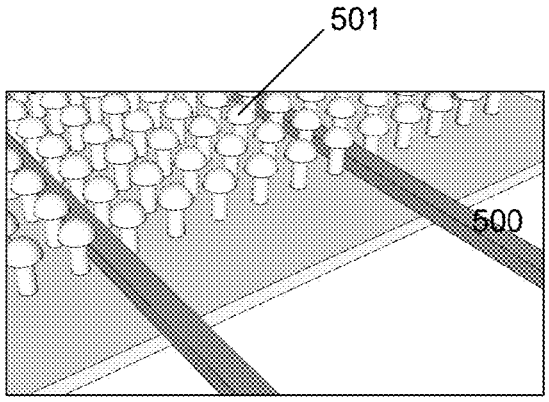
FIG. 5B illustrates an exemplary embodiment of an RFS with an alternate article.

Referring now to FIGS. 5A-5B, an exemplary embodiment of an RFS 500 with an article 500 positioned between fastener components 501-502 without deforming the fastener components 501-502 is illustrated. In some aspects, fastener series may hermaphroditically engage, securely embedding the article within the RFS 504.

In FIG. 5B a close up of an article 500 secured beneath mushroom shaped hermaphroditic fasteners 501 is illustrated. As illustrated, the article 500 includes a square shaped cross section, other shaped cross sections, such as a generally round shaped cross section are within the scope of the present invention. The shape of a cross section may be used to promote stability of an article 500 secured in a RFS system 504.

Figure 6A:
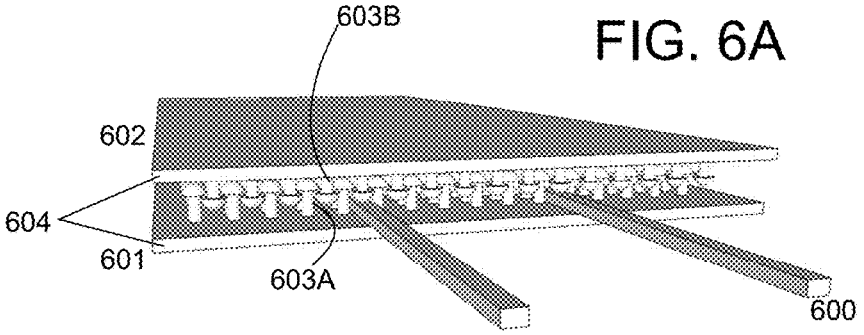
FIG. 6A illustrates an exemplary embodiment of an RFS with an exemplary embedded article.
Figure 6B:
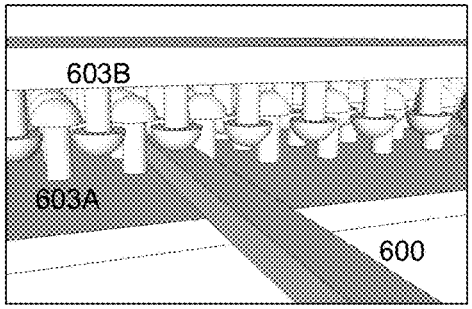
FIG. 6B illustrates an exemplary embodiment of an RFS with an exemplary embedded article.

Referring now to FIGS. 6A-6B, an exemplary embodiment of an RFS 604 with an exemplary first component strip 601 and a second component strip 602 is illustrated. The components include hermaphroditic mushroom shaped components, or other components, such as hook and loop shaped components. As illustrated, an article 600 may be embedded within the series of fastener components 603A-603B such as mushroom shaped components or hook and loop components. In some embodiments, when the complementary mushroom fastener series components 603A-603B may engage each other, interlocking mushroom fasteners may be positioned over the embedded article, further securing its position within the RFS 604.

Figure 7A:
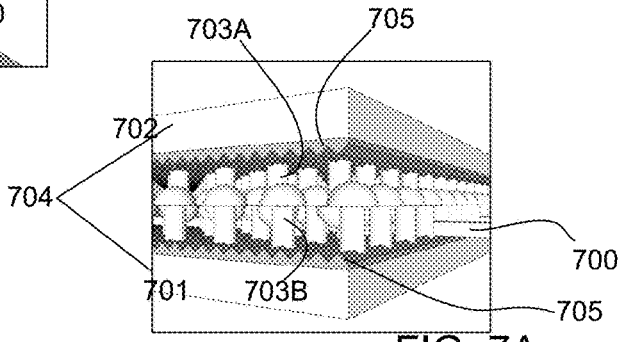
FIG. 7A illustrates an exemplary embodiment of an RFS with an exemplary embedded article.
Figure 7B:
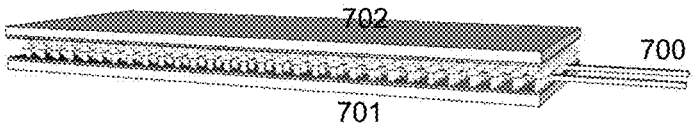
FIG. 7B illustrates an exemplary embodiment of an RFS with an exemplary embedded article.
Figure 7C:
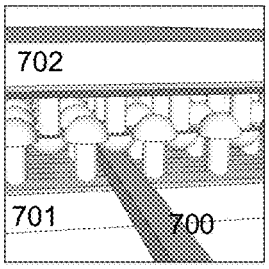
FIG. 7C illustrates an exemplary embodiment of an RFS with an exemplary embedded article.

Referring now to FIGS. 7A-7C, exemplary embodiments of an RFS 704 with substrate halves that include a first strip of fastener components 701, a second strip of fastener components 702 and an exemplary embedded article 700 is illustrated.

According to some embodiments, of the present invention, one or both substrate half may further include a resilient layer 705. The resilient layer 705 may form against an article 700 when the article 700 is secured between the first strip 701 and the second strip 702, with the fastener components 703A-703B. In some embodiments, the resilient layer 705 may include a textured material, which may limit the ability of the article to slide within the void or fastener system. In some aspects, the resilient layer may include a formable material, which may compress and thereby allow a secondary type embedding of an article 700 secured between a first substrate strip 701 and a second substrate strip 702. As the components 703A-703B engage, the article 700 may be forced into the resilient layer 705 and provide a compressive force between the article 700 and the resilient layer 705.

Figure 8:
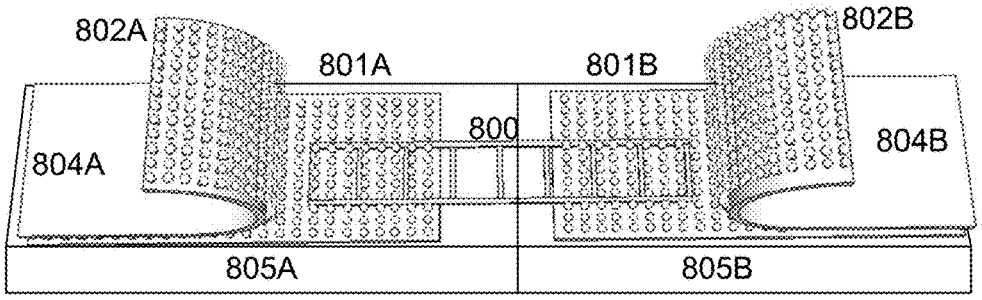
FIG. 8 illustrates an exemplary embodiment of a complementary RFS with an exemplary embedded article.

Referring now to FIG. 8, exemplary embodiments of complementary RFSs 804A-804B with an exemplary embedded article 800 is illustrated. As illustrated, the complementary RFSs 804A-804B may act in conjunction to secure the embedded article. In some aspects, RFSs may be combined, wherein a portion of an article 800 may be embedded in each RFS 804A-804B. Each RFS 804A-804B may be fixedly attached to a respective object 805A-805B. The respective RFSs 804A-804B may be fixed to respective objects 805A-805B, for example, via an adhesive, a rivet, a screw, a bolt or other fastener. The respective RFSs 804A-804B may include first substrate strips and components that make up first complementary halves 801A-B and second substrate strips and components that make up second complementary halves 802A-B which interlock to secure an article 800 between them.

Figure 9A:
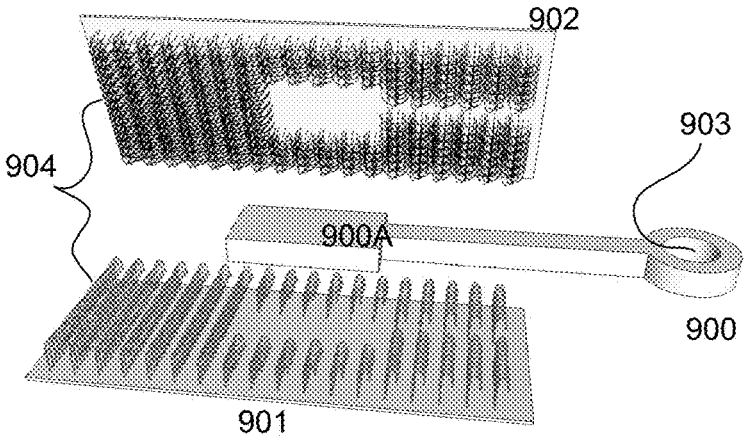
FIG. 9A illustrates an exemplary embodiment of an RFS with an exemplary embedded article.
Figure 9B:
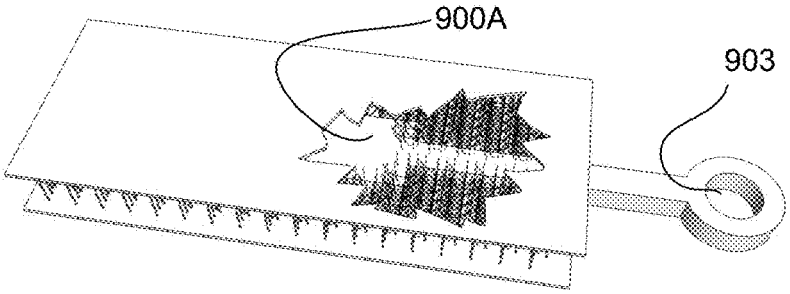
FIG. 9B illustrates an exemplary embodiment of an RFS with an exemplary embedded article.

Referring now to FIGS. 9A-9B, an exemplary embodiment of an RFS 904 with an exemplary embedded article is illustrated. As illustrated, in some embodiments, the fastener series may include a hook and loop fastener attached to a first substrate strip 901 and a second substrate strip 902. In some aspects, both substrate strips 901-902 may include voids. The voids may be configured to outline an article which will be secured in between the first substrate strip 901 and the second substrate strip 902 wherein the dual voids may allow the fasteners to completely engage an article 900 by surrounding the article 900. In some embodiments, the article 900 may include a keyed portion 900A shaped to engage a shape of a void, wherein the void is an area of one or both of the fastener substrates strips 901-902 devoid of fastening components, such as hook and loop materials, mushroom shaped hermaphroditic fasteners, or other removably engaging fasteners. The article may also include external interaction device 903 for fastening the article 900 to an external device. As illustrated, the external interaction includes a cylinder shaped connector that may be used to contain a bolt, a rivet, a cable, a tie, a screw or other connecting device. It is appreciated that voids and articles may take a wide variety of shapes and forms.

Figure 10:
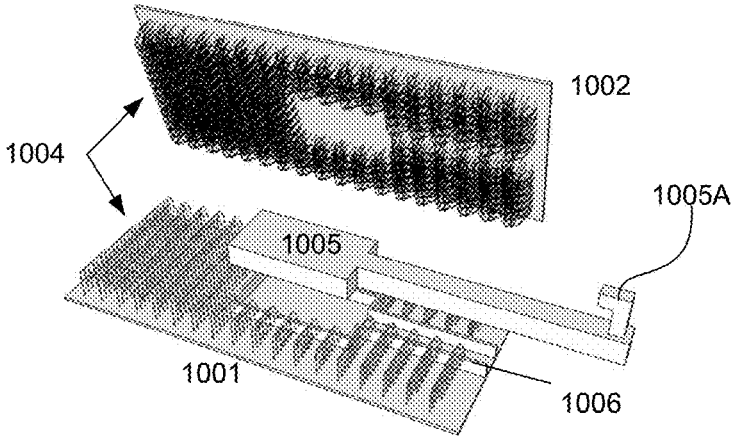
FIG. 10 illustrates an exemplary embodiment of an RFS with an exemplary embedded article.

Referring now to FIG. 10, an exemplary embodiment of an RFS 1004 with an exemplary embedded article 1005 is illustrated, wherein the RFS 1004 comprises complementary component strips 1001, 1002. In some embodiments, a substrate half may further include a stability frame 1006, the stability frame 1006 may add mechanical support and act as a guide for receiving and positioning one or more articles 1005 within the RFS while a first fastener series of substrate and components is engaged with a second fastener series of substrate of components using complementary components attached to each component substrate such that a first half of the RFS with components is engaged to a second half of an RFS. In some preferred embodiments a stability frame 1006 will frame a patterned area void of fastener components. In some aspects, the stability frame may more precisely fit the article and limit shifting between the fasteners. In some specific embodiments, a stability frame may be sized and positioned to receive one or more of, or multiples of: a wire, a ribbon cable, a tube, a pipe, a fiber optic cable or other linear type shaped article.

The stability frame 1006 may also provide for increased mechanical properties, such as an increased modulus or rigidity in an X or Y direction relative to a surface of a component substrate strip.

In still another aspect, a stability frame 1006 may be fixedly attached to an object onto which the substrate strip is adhered. Attachment may be accomplished via one or more pins, screws, rivets, adhesive, welding or other vehicle for creating a fixed or removable attachment. In some embodiments, the article 1005 may include a device for connecting to an external object 1005A. As illustrated, the device for connecting to an external object 1005A includes a hook, other devices may include a clip, a carabineer, a snap, a not and/or bolt, a rivet, or other device.

Figure 11A:
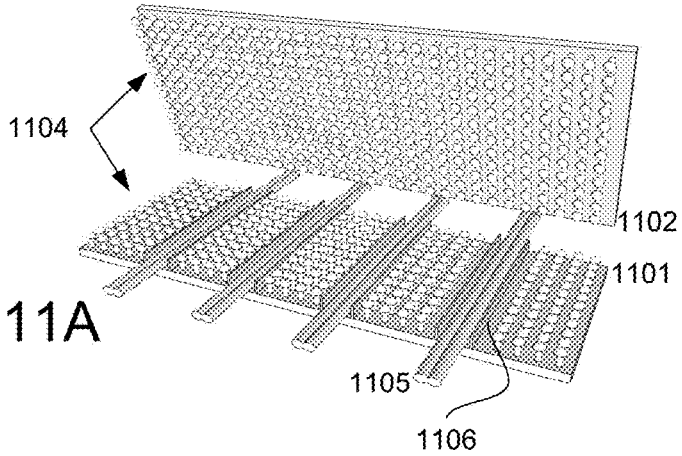
FIG. 11A illustrates an exemplary embodiment of an RFS with an exemplary embedded article.

Referring now to FIG. 11A, an exemplary embodiment of an RFS 1104 with an exemplary embedded article is illustrated, wherein the embedded article 1105 includes one or more wires or tubes. In some embodiments, a substrate strip 1101-1102 may further include one or more pass-through stability frames 1106, which may designate specific paths through the RFS 1104 for guiding the wires, tubes, pipes or other article 1105.

Figure 11B:
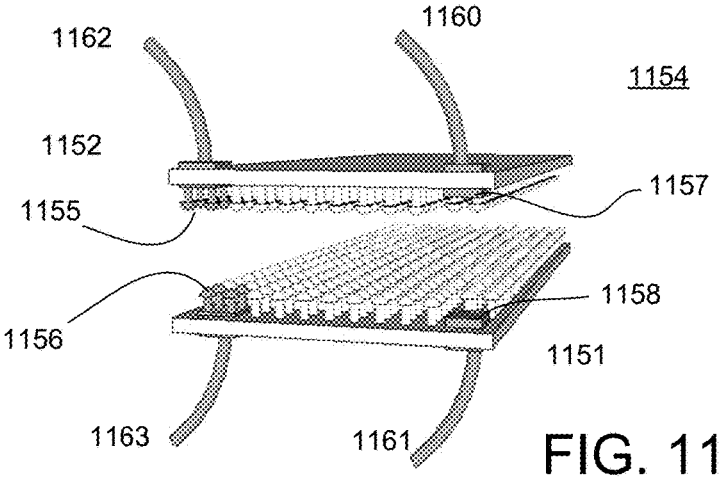
FIG. 11B illustrates an exemplary embodiment of an RFS with an exemplary embedded article, wherein the embedded article includes one or more wires or tubing passing through the RFS in a perpendicular manner.

Referring now to FIG. 11B, an exemplary embodiment of an RFS 1154 with an exemplary embedded article 1160-1163 is illustrated, wherein the embedded article 1160-1163 includes one or more wires or tubing passing through the RFS 1154. In some embodiments, a substrate strip 1151, 1152 may further include one or more reinforced or specialized fasteners 1155-1158, which may be specially fitted to secure the pass-through articles 1160-1163. For example, the pass-through articles 1162, 1163 may comprise wires susceptible to moisture, and the specialized fasteners 1155, 1156 may protect pass-through articles 1162, 1163 from the external environment. In some embodiments, the specialized fasteners 1155, 1156 may increase stability around the pass-through articles 1162, 1163, which may further limit horizontal and vertical movement of the substrate strip 1151, 1152 near the pass-through articles 1162, 1163.

As another example, the pass-through articles 1160, 1161 may comprise components of a circuit, wherein contact between the two components provides electrical communication between an electrical contact in a first substrate with an electrical contact in a second substrate. In some exemplary embodiments, the electrical communication may complete an electrical circuit. The electrical circuit may include one or both of active electrical devices and passive electrical devices. In still another aspect, completing the electrical circuit may activate the devices included in the circuit. In some aspects, specialized fasteners 1157, 1158 may comprise conductive material, and a portion of the pass-through articles 1160, 1161 may embed or directly contact the specialized fasteners 1157, 1158, wherein the conductive material may stabilize the electrical connection between the components of the circuit. Placing a first electrical contact in communication with the second electrical contact may include conveyance of a data signal, such as, for example a digital data signal or an analogue data signal. In another aspect, placing a first electrical contact in communication with the second electrical contact may include conveyance of an electrical current, such as for example an alternating current and a direct current electrical flow.

Figure 12A:
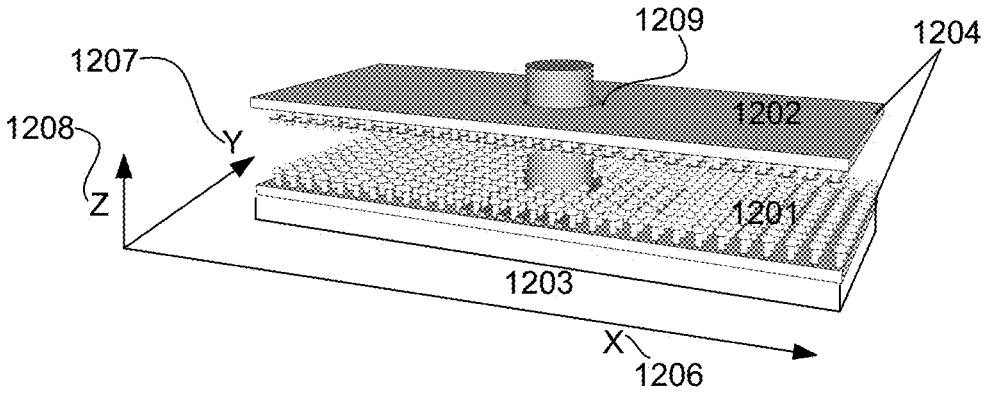
FIG. 12A illustrates an exemplary embodiment of an RFS with an exemplary embedded article, wherein the RFS further includes a penetrating article.
Figure 12B:
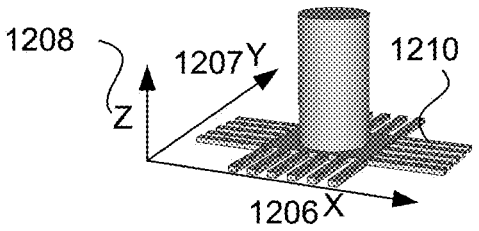
FIG. 12B illustrates an exemplary embodiment of an RFS with an exemplary embedded article, wherein the RFS further includes a penetrating article.

Referring now to FIGS. 12A-12B, in some embodiments of the present invention, a RFS 1204 attached to an object 1203 may further include an X, Y reinforcement, such as, for example, a stud penetrating one or both component strips 1201-1202. The X, Y reinforcement will generally provide resistance against movement in one or both of an X direction 1206 and Y direction 1207, but not limit movement in a Z direction 1208. In some embodiments, a substrate strip 1201-1202 may include an opening 1209, which allows an X, Y reinforcement to penetrate one or both component substrate strips 1201-1202. In some embodiments, the complementary component substrate strip 1201-1202 may accept a base portion of the penetrating X, Y reinforcement, wherein the each component substrate strip 1201-1202 may be configured to match the spacing of the fastener series.

In some embodiments, an X, Y reinforcement may be molded as part of a first component substrate strip 1201. In some additional embodiments, an X, Y reinforcement may be attached to an object 1203 to which a first component strip 1201 is attached. Attachment may include, for example, a screw, a bolt, a tack, a weld, an adhesive or other attachment mechanism.

Referring now to FIG. 12B, in some embodiments, an X, Y reinforcement may be supported by an X, Y support platform 1210. The X, Y support platform 1210 may be positioned underneath a first component substrate strip 1201 and prevent the X, Y reinforcement from pulling through the first component substrate strip 1201. In some embodiments, the X, Y support platform 1210 may be fixedly attached to an object 1203 to which the first component substrate strip 2101 is attached.

In some implementations, the X, Y support platform 1210 may comprise teeth that may fit within the fasteners of one or both the first and second component substrate strips 1201, 1202. In some aspects, the X, Y support platform 1210 may add X, Y strength, which, for example, may be useful for hanging items in X, Y direction, separating items in the Z direction, or acting as a dowel if through both component substrate strips 1201, 1202. In some embodiments, the X, Y support platform 1210 may also limit rotation of the stud. In some embodiments, not shown, the X, Y support platform 1210 may be integrated into one or both component substrate strips 1201, 1202 or may be attached to the object 1203.

Figure 13A:
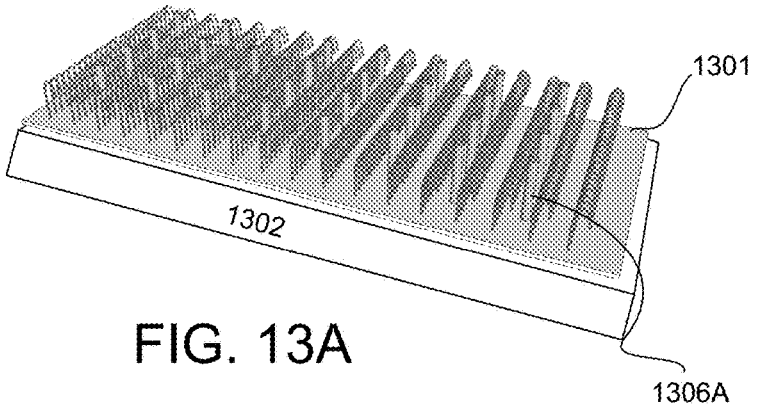
FIG. 13A illustrates an exemplary embodiment of an RFS with exemplary studs.
Figure 13B:
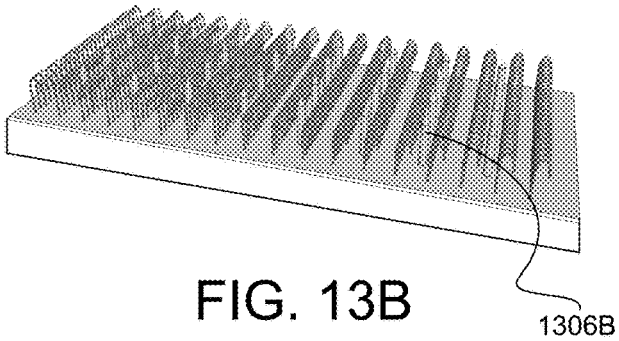
FIG. 13B illustrates an exemplary embodiment of an RFS with exemplary studs.
Figure 13C:
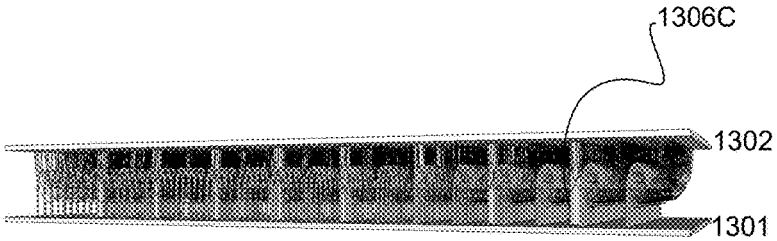
FIG. 13C illustrates an exemplary embodiment of an RFS with exemplary studs.

Referring now to FIGS. 13A-13C, in various exemplary embodiments of the present invention, an RFS 1301 may include X, Y reinforcements that include studs 1306A. In some aspects, a first component substrate strip 1301 may include a series of studs 1306A, which may enhance stability of embedded articles. In some embodiments, the series of studs 1306A may be offset from the fastener series, wherein the studs may be positioned in the gaps between the fasteners. In some aspects, the X, Y reinforcements 1306B may include studs with tipped ends, such as a pointed or barbed end. The tipped ends may embed into the surface of a second component substrate strip 1302 when the first and second component substrate strips 1301-1302 are engaged.

In still another respect, referring now to FIG. 13C, an X, Y reinforcement that includes a stud 1306C may be used as an offset to determine an amount of space between a first strip 1301 and a second strip 1302.

Figures 14A, 14B, 14C:
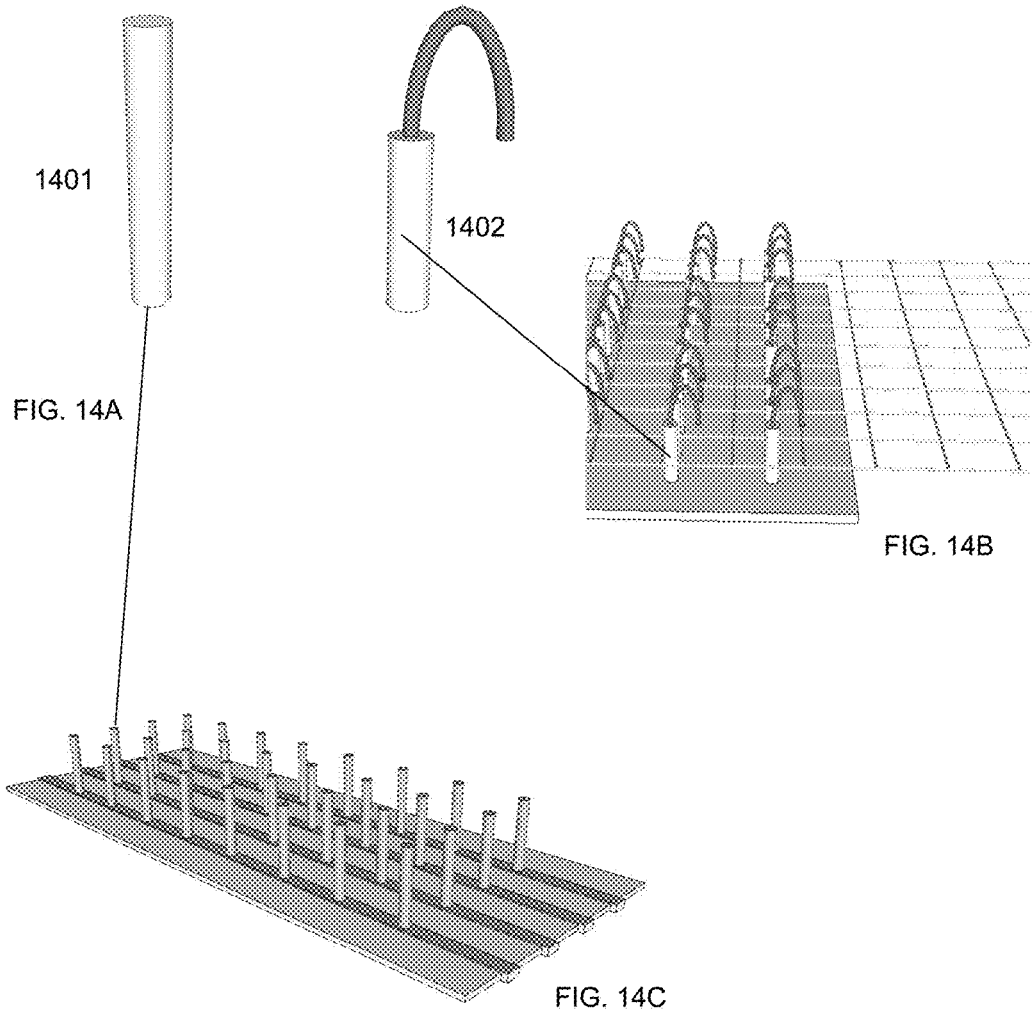
FIG. 14A illustrates exemplary embodiments of studs and stud configurations.
FIG. 14B illustrates exemplary embodiments of studs and stud configurations.
FIG. 14C illustrates exemplary embodiments of studs and stud configurations.

Referring now to FIGS. 14A-14C, exemplary embodiments of X, Y reinforcements with hook and loop type studs reinforcements are illustrated. In some aspects, a stud 1401 supports the hook portion of a series of hook and loop type hooks. Embodiments may therefore include a functional combination of a hook type fastener with a tubular reinforcement 1402 around a base of one or more hooks. In such aspects, the fastener portion may extend from the stud portion. Other embodiments, allow for an X. Y reinforcement In some aspects, a substrate half may further include a mesh gauge, which may further secure the positioning of one or more of the studs, fasteners, and embedded article. In some embodiments, a substrate half may further include lateral reinforcement of the studs, which may limit lateral shifting of a semi-rigid material.

As an illustrative example, an article may comprise a mesh, which may fit into the fastener pattern of a substrate strip. The mesh article may be used to hang a curtain, wherein the mesh article may be attached to curtain. The lateral reinforcement of the studs may add sufficient X direction stability wherein the RFS may withstand a pull in the x direction that may occur from hanging and moving the curtain. In some embodiments an article may be designed to provide sufficient stability in the X and Y directions without reinforcing fasteners or additional components. In such embodiments the characteristics of the article may enhance stability of an article within a conventional refastener system. Characteristics of an article may include for example, one or more of: shape, size, flexibility, texture or other characteristics.

Figure 15:
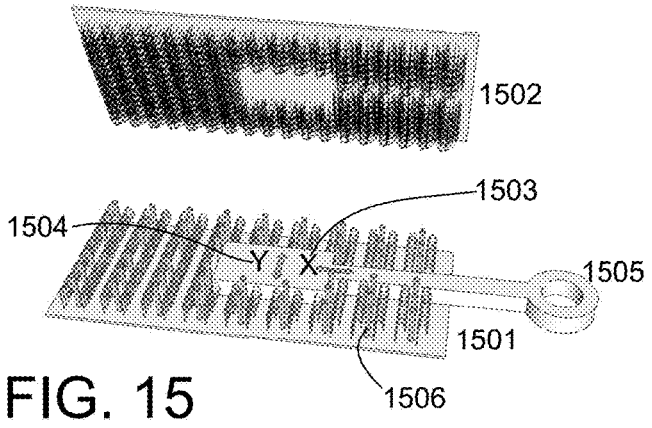
FIG. 15 illustrates an exemplary embodiment of an RFS with an exemplary embedded article.

Referring now to FIG. 15, in some embodiments RFS component strips 1501-1502 may include embedded X, Y reinforcements. In some aspects, each substrate component strip 1501-1502 may include one or both of a series of studs 1506. In some aspects, such RFS component strip 1501-1502 configurations may limit movement of an embedded article in an X direction 1503 and a Y direction 1504, before and after the fasteners are engaged. In some aspects, applying force to an embedded article may cause the fasteners to more deeply engage, which may add further security of the embedded article 1505.

Figure 16:
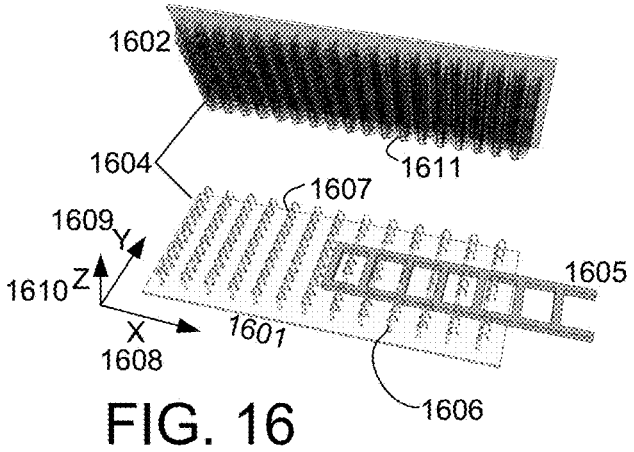
FIG. 16 illustrates an exemplary embodiment of an RFS with an exemplary embedded article.

Referring now to FIG. 16, an exemplary embodiment of an RFS 1604 with an exemplary embedded article 1605 is illustrated. In some aspects, the RFS 1604 includes multiple hook 1607 and loop 1608 fasteners, wherein a first component substrate strip 1601 includes a void shaped to receive an article 1605 and a series of hybrid studs 1606 and interacts with a second substrate strip 1602. In some embodiments, the embedded article 1605 may include a ladder shape, wherein the lateral or other X 1608, Y 1609 movement may be limited by the hybrid stud series 1606, and the vertical movement in a Z direction 1610, may be limited by fully engaged fasteners 1607-1611 but relatively unimpeded by the hybrid studs 1606.

Figure 17:
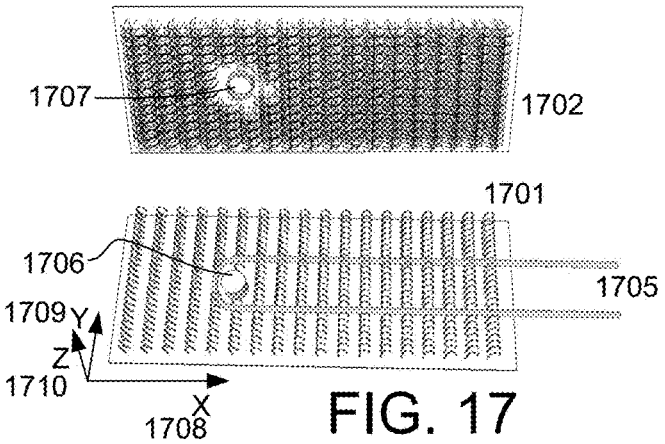
FIG. 17 illustrates an exemplary embodiment of an RFS with an exemplary embedded article.

Referring now to FIG. 17, in some embodiments, component substrate strips 1701-1702 may further include a complementary stud 1706 and stud receptacle 1707, wherein a stud on one substrate half 1701 may fit into a stud receptacle 1707 on the other substrate half 1702. In some embodiments, an embedded article 1705 may loop or hook around one or both of: the complementary stud 1706 and the receptacle 1707, wherein movement may be limited in a lateral X 1708 and Y 1709 direction due to the resistive force of fasteners and particularly in the X 1708 direction due to the resistive force of the engaged stud 1706 and stud receptacle 1707 and, other than the connective force of the inter-engaging fasteners, relatively unimpeded in a vertical or Z 1710 direction when force is applied to the looped article. In some aspects, a looped article may be useful for hanging or locking purposes.

As can be seen in the exemplary embodiments described herein, during use of the concepts of the present invention, a complementary article may be embedded within an RFS and connection may be made with increased mechanical strength in the lateral X, Y directions and ease of connection and disconnection is maintained according to the ease of engagement and disengagement of the RFS system employed.

CONCLUSION

A number of embodiments of the present disclosure have been described. While this specification contains many specific details, there should not be construed as limitations on the scope of any disclosures or of what may be claimed, but rather as descriptions of features specific to particular embodiments of the present disclosure.

What is claimed is:

1. A reclosable fastener system for securely containing an embedded article, wherein the reclosable fastener system includes:

the embedded article comprising an electrical conduit;

a first reclosable fastener substrate comprising a first generally planar base;

multiple first fastener components fixedly attached to the first reclosable fastener substrate;

a second reclosable fastener substrate comprising a second generally planar base;

multiple second fastener components fixedly attached to the second reclosable fastener substrate, wherein the second fastener components are complementary to the first fastener components and when engaged with the first fastener components provide for limited motion of the embedded article between the first reclosable fastener substrate and the second reclosable fastener substrate in either of an X direction and a Y direction while allowing for motion of the article embedded between the first reclosable fastener substrate and the second reclosable fastener substrate in a Z direction, wherein movement in the Z direction disengages the first fastener components from the second fastener components and disengagement of the first fastener components from the second fastener components allows movement in the X direction and Y direction;

the first reclosable fastener substrate and second reclosable fastener substrate are arranged to purposefully receive the embedded article comprising a specific shape and size into a patterned area in the one of the first and second fastener substrates that is void of fastener components, said patterned area based upon the specific shape and size of the article to be received, the article is receivable in a manner that will allow for a substantial engagement of the first fastener components and the second fastener components in an area proximate to the article and secure the article between the first reclosable fastener substrate and the second reclosable fastener substrate with a tensile strength of restraint in the X direction and the Y direction greater than a tensile strength of restraint in the Z direction, while the patterned area is void of one or both of the first fastener components and the second fastener components; and a pass through stability frame designating a path through one or both of: the first fastener components and the second fastener components, wherein the stability frame frames the patterned area, is also based upon a size and shape of the article and positions the electrical conduit, provides increased stability around the electrical conduit, and provides increased mechanical properties in one or both of an X and a Y direction and approximately a same mechanical property in a Z direction relative to the first generally planar base.

2. The reclosable fastener system of claim 1 wherein the stability frame provides protection to at least a portion of the embedded article from an external environment.

3. The reclosable fastener system of claim 2 comprising an X, Y reinforcement providing resistance against movement of the embedded article received into the patterned area in both an X direction and a Y direction relative to the first generally planar base, wherein the stability frame does not significantly limit movement of the article received into the patterned area in a Z direction relative to the first generally planar base.

4. The reclosable fastener system of claim 3 wherein the X, Y reinforcement comprises a stud penetrating one or both of the first reclosable fastener substrate and the second reclosable fastener substrate and the stud supports the first substrate and the second substrate and the stability frame.

5. The reclosable fastener system of claim 3 wherein the X, Y reinforcement is fixedly attachable to an object onto which one of: the first reclosable fastener substrate and the second reclosable fastener substrate, is mounted.

6. The reclosable fastener system of claim 5 wherein the X, Y reinforcement is fixedly attachable to an object onto which one of the first reclosable fastener substrate and the second reclosable fastener substrate is mounted via at least one of: a bolt, a screw and a rivet.

7. The reclosable fastener system of claim 1 additionally comprising a first electrical contact positioned within the patterned area of the first substrate and a second electrical contact attached to the second substrate in a position causing electrical communication between the first electrical contact and the second electrical contact when the first fastener components engage with the second fastener components.

8. The reclosable fastener system of claim 7 wherein when the first substrate is engaged with the second substrate and the first electrical contact is in electrical communication with the second electrical contact, an electrical current flows between the first electrical contact and the second electrical contact.

9. The reclosable fastener system of claim 7 wherein the embedded article further comprises an active electrical component.

10. The reclosable fastener system of claim 7 wherein the embedded article further comprises a passive electrical component.

11. The reclosable fastener system of claim 7 additionally comprising specialized fasteners comprising conductive material and the specialized fasteners further stabilize an electrical connection between the first electrical contact and the second electrical contact.

12. A method of securing an article with a reclosable fastener system, the method comprising the steps of:

placing the article comprising an electrical conduit of a predetermined size and shape into a pass through stability frame in contact with a first reclosable fastener substrate comprising a generally planar first fastener base and multiple first fastener components arranged to form a first patterned area void of fastener components complementary to the size and shape of the article, and at least a portion of the first reclosable fastener substrate comprises a first electrical contact positioned within the first patterned area;

fixedly attaching the first reclosable fastener substrate to a second reclosable fastener substrate comprising second fastener components arranged to form a second patterned area and a generally planar second fastener base, which second fastener base comprises a second electrical contact within the second patterned area, said first fastener components patterned to receive the pass through stability frame according to the size and shape of the article;

placing the first electrical contact included in first patterned area in a X position, Y position and Z position causing electrical communication with the second electrical contact included in the second patterned area;

passing an electrical current through the first electrical contact and the second electrical contact engaging the first reclosable fastener substrate with the second reclosable fastener substrate thereby securing the article within the stability frame in an X direction and a Y direction relative to the generally planar first fastener base and within the first patterned area and between the first reclosable fastener substrate and the second reclosable fastener substrate;

disengaging the first reclosable fastener substrate from the second reclosable fastener substrate by movement in a Z direction; and moving the article in the Z direction to extract the article from within the first patterned area.

13. The method of claim 12 wherein the electrical communication comprises one of: transferring a data signal and transferring an electrical current.

* * * * *